US006226798B1

(12) United States Patent
Le Blanc et al.

(10) Patent No.: US 6,226,798 B1
(45) Date of Patent: May 8, 2001

(54) MASTECTOMY AND SHUNT COVERAGE ASSEMBLY

(76) Inventors: Donald A. Le Blanc; Patricia M. Le Blanc, both of 1208 Mercury Ave., Metairie, LA (US) 70003

( * ) Notice: Subject to any disclaimer, the term of this patent is extended or adjusted under 35 U.S.C. 154(b) by 0 days.

(21) Appl. No.: 09/648,136

(22) Filed: Aug. 25, 2000

(51) Int. Cl.[7] ..... A41D 13/00
(52) U.S. Cl. ..... 2/69; 2/104; 2/46
(58) Field of Search ..... 2/46, 48, 49.1, 2/88, 104, 106, 114; 602/3, 60, 61; 450/1, 81

(56) References Cited

U.S. PATENT DOCUMENTS

| | | | | |
|---|---|---|---|---|
| D. 59,555 | | 11/1921 | Ladd . | |
| D. 399,033 | | 9/1998 | Hall et al. . | |
| 709,767 | * | 9/1902 | Higgins | 602/3 |
| 2,896,216 | * | 7/1959 | Spewak | 2/69 |
| 3,154,789 | * | 11/1964 | Lewis, Jr. | 2/114 |
| 3,221,341 | * | 12/1965 | Hummel | 2/49.1 |
| 3,329,144 | * | 7/1967 | Liman | 602/3 |
| 3,616,464 | | 11/1971 | Whitten . | |
| 4,474,559 | * | 10/1984 | Steiger | 434/268 |
| 4,571,743 | * | 2/1986 | Wagoner | 2/88 |
| 4,911,151 | | 3/1990 | Rankin et al. . | |
| 4,919,081 | * | 4/1990 | Lewellen | 119/537 |
| 5,088,117 | * | 2/1992 | Fulmer | 2/114 |
| 5,181,274 | | 1/1993 | Defiore . | |
| 5,342,287 | | 8/1994 | Jernoiu . | |
| 5,609,569 | * | 3/1997 | Offenhartz | 602/61 |
| 5,950,235 | * | 9/1999 | Tata | 2/48 |

* cited by examiner

*Primary Examiner*—Gloria M. Hale

(57) ABSTRACT

A mastectomy and shunt coverage assembly for protecting the area of a mastectomy or shunt while showering. The mastectomy and shunt coverage assembly includes a main member with an opening for receiving an arm of the user and an interior edge, the interior edge has a front portion positionable to abut the chest of the user, a back portion positionable to abut the back of the user, and a top portion positionable to abut the shoulder of the user, an adhesive strip is coupled to the main member and adapted for removably affixing the main member to the user forming a moisture proof seal between the interior edge and the user.

9 Claims, 3 Drawing Sheets

MASTECTOMY AND SHUNT COVERAGE ASSEMBLY

BACKGROUND OF THE INVENTION

1. Field of the Invention

The present invention relates to wound protective devices and more particularly pertains to a new mastectomy and shunt coverage assembly for protecting the area of a mastectomy or shunt while showering.

2. Description of the Prior Art

The use of wound protective devices is known in the prior art. More specifically, wound protective devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,181,274; U.S. Pat. No. 4,911,151; U.S. Pat. No. 5,342,287; U.S. Pat. No. 3,616,464; U.S. Pat. No. Des. 59,555; and U.S. Pat. No. Des. 399,003.

While these devices fulfill their respective, particular objectives and requirements, the aforementioned patents do not disclose a new mastectomy and shunt coverage assembly. The inventive device includes a main member with an opening for receiving an arm of the user and an interior edge, the interior edge has a front portion positionable to abut the chest of the user, a back portion positionable to abut the back of the user, and a top portion positionable to abut the shoulder of the user, an adhesive strip is coupled to the main member and adapted for removably affixing the main member to the user forming a moisture proof seal between the interior edge and the user.

In these respects, the mastectomy and shunt coverage assembly according to the present invention substantially departs from the conventional concepts and designs of the prior art, and in so doing provides an apparatus primarily developed for the purpose of protecting the area of a mastectomy while showering.

SUMMARY OF THE INVENTION

In view of the foregoing disadvantages inherent in the known types of wound protective devices now present in the prior art, the present invention provides a new mastectomy and shunt coverage assembly construction wherein the same can be utilized for protecting the area of a mastectomy while showering.

The general purpose of the present invention, which will be described subsequently in greater detail, is to provide a new mastectomy and shunt coverage assembly apparatus and method which has many of the advantages of the wound protective devices mentioned heretofore and many novel features that result in a new mastectomy and shunt coverage assembly which is not anticipated, rendered obvious, suggested, or even implied by any of the prior art wound protective devices, either alone or in any combination thereof.

To attain this, the present invention generally comprises a main member with an opening for receiving an arm of the user and an interior edge, the interior edge has a front portion positionable to abut the chest of the user, a back portion positionable to abut the back of the user, and a top portion positionable to abut the shoulder of the user, an adhesive strip is coupled to the main member and adapted for removably affixing the main member to the user forming a moisture proof seal between the interior edge and the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mastectomy and shunt coverage assembly apparatus and method which has many of the advantages of the wound protective devices mentioned heretofore and many novel features that result in a new mastectomy and shunt coverage assembly which is not anticipated, rendered obvious, suggested, or even implied by any of the prior art wound protective devices, either alone or in any combination thereof.

It is another object of the present invention to provide a new mastectomy and shunt coverage assembly which may be easily and efficiently manufactured and marketed.

It is a further object of the present invention to provide a new mastectomy and shunt coverage assembly which is of a durable and reliable construction.

An even further object of the present invention is to provide a new mastectomy and shunt coverage assembly which is susceptible of a low cost of manufacture with regard to both materials and labor, and which accordingly is then susceptible of low prices of sale to the consuming public, thereby making such mastectomy and shunt coverage assembly economically available to the buying public.

Still yet another object of the present invention is to provide a new mastectomy and shunt coverage assembly which provides in the apparatuses and methods of the prior art some of the advantages thereof, while simultaneously overcoming some of the disadvantages normally associated therewith.

Still another object of the present invention is to provide a new mastectomy and shunt coverage assembly for protecting the area of a mastectomy while showering.

An even further object of the present invention is to provide a new mastectomy and shunt coverage assembly for protecting the area of a shunt while showering.

Yet another object of the present invention is to provide a new mastectomy and shunt coverage assembly which includes a main member with an opening for receiving an arm of the user and an interior edge, the interior edge has a front portion positionable to abut the chest of the user, a back portion positionable to abut the back of the user, and a top portion positionable to abut the shoulder of the user, an adhesive strip is coupled to the main member and adapted for removably affixing the main member to the user forming a moisture proof seal between the interior edge and the user.

Still yet another object of the present invention is to provide a new mastectomy and shunt coverage assembly that helps maintain a sense of independence and dignity for the user during recovery from a mastectomy.

Even still another object of the present invention is to provide a new mastectomy and shunt coverage assembly that can be utilized without assistance from a second person.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
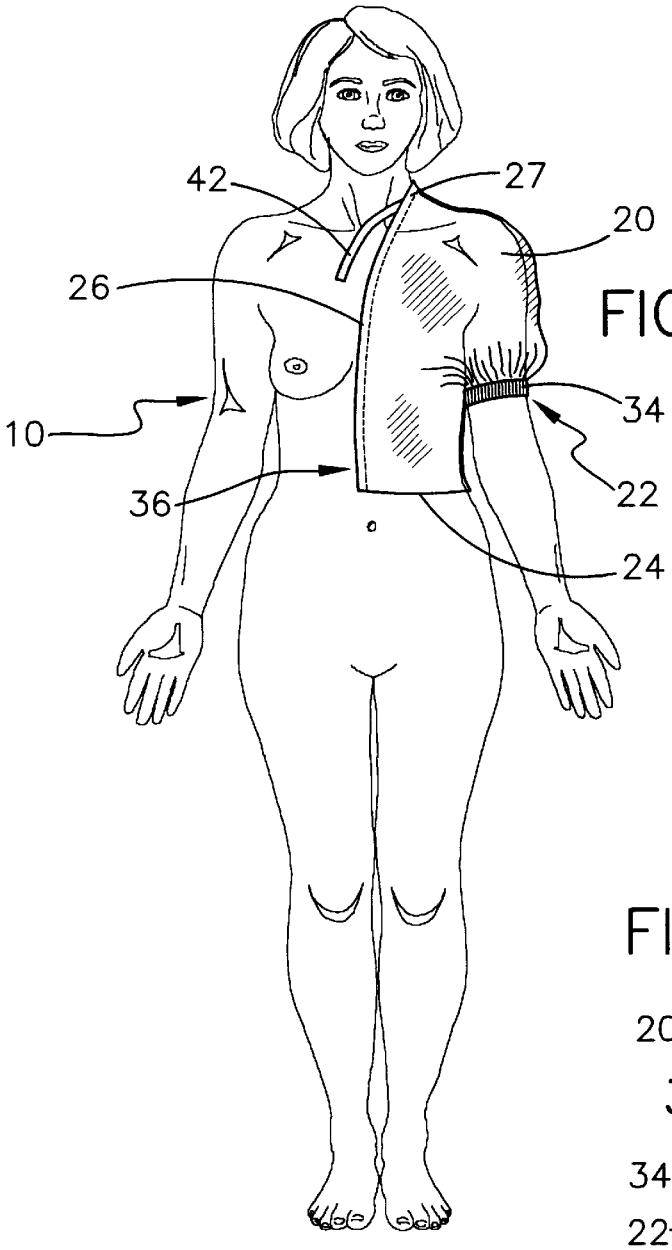
FIG. 1 is a schematic front view of a new mastectomy and shunt coverage assembly according to the present invention.
Figure 2:
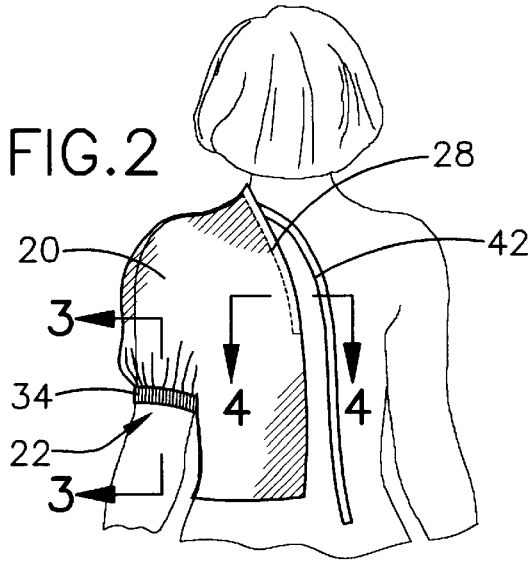
FIG. 2 is a schematic rear view of the present invention.
Figure 3:
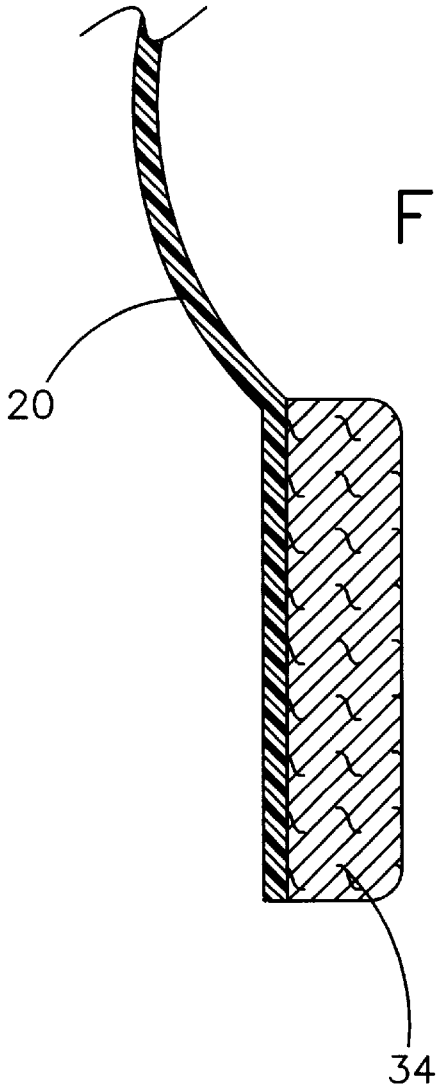
FIG. 3 is a schematic cross-sectional view of the present invention taken along line 3—3 of FIG. 2.
Figure 4:
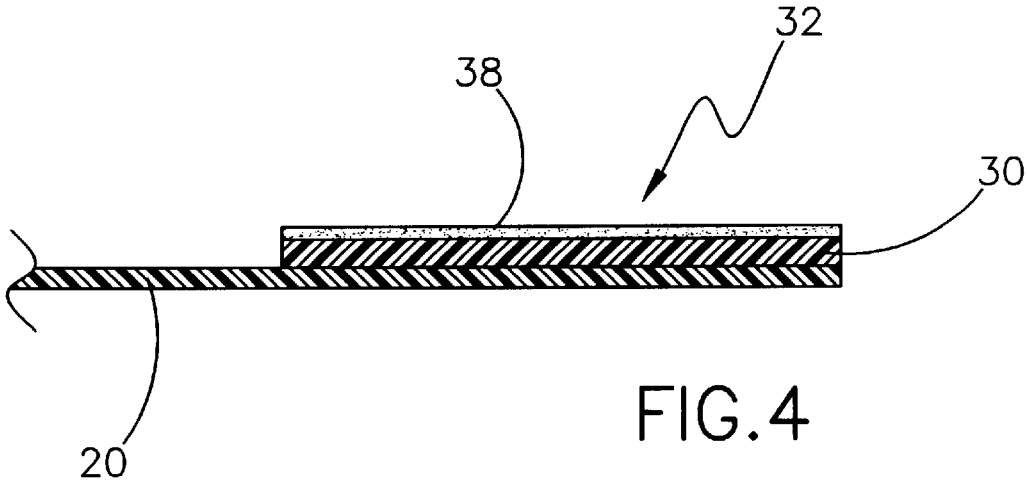
FIG. 4 is a schematic cross-sectional view of the present invention taken along line 4—4 of FIG. 2.
Figure 5:
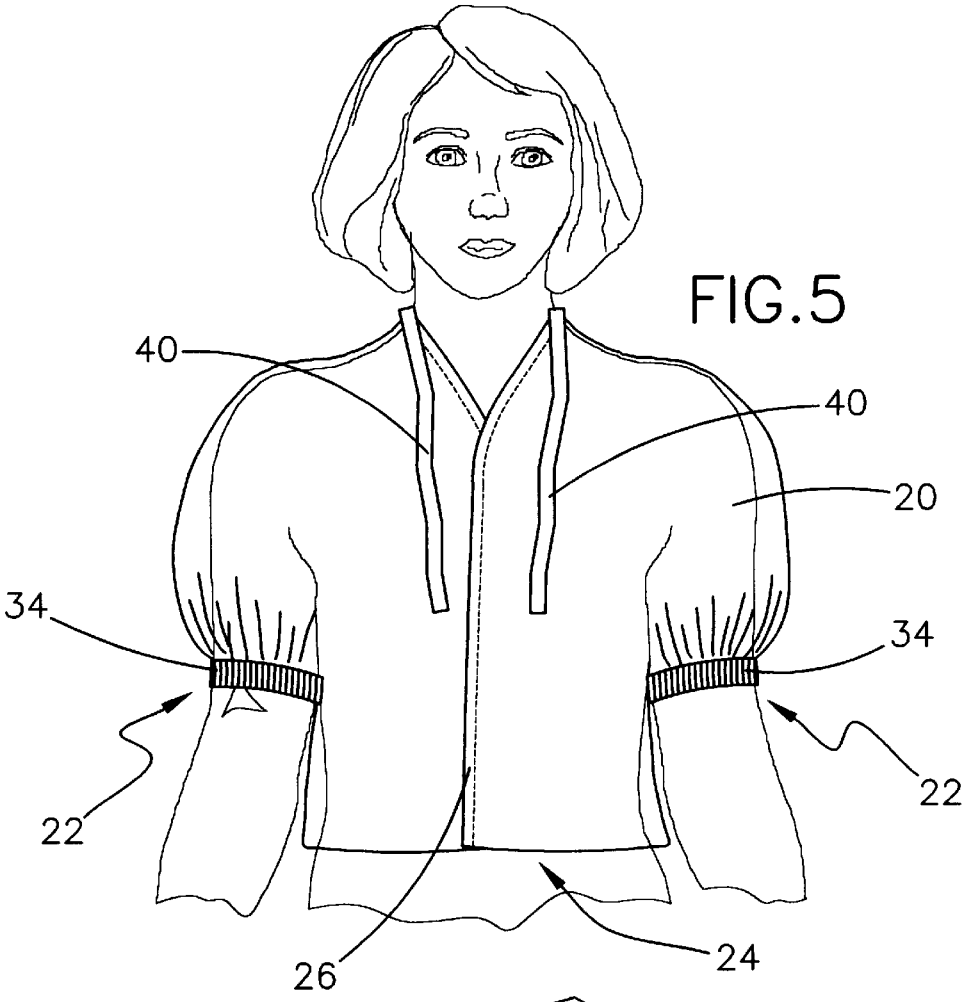
FIG. 5 is a schematic front view of an embodiment of the present invention.
Figure 6:
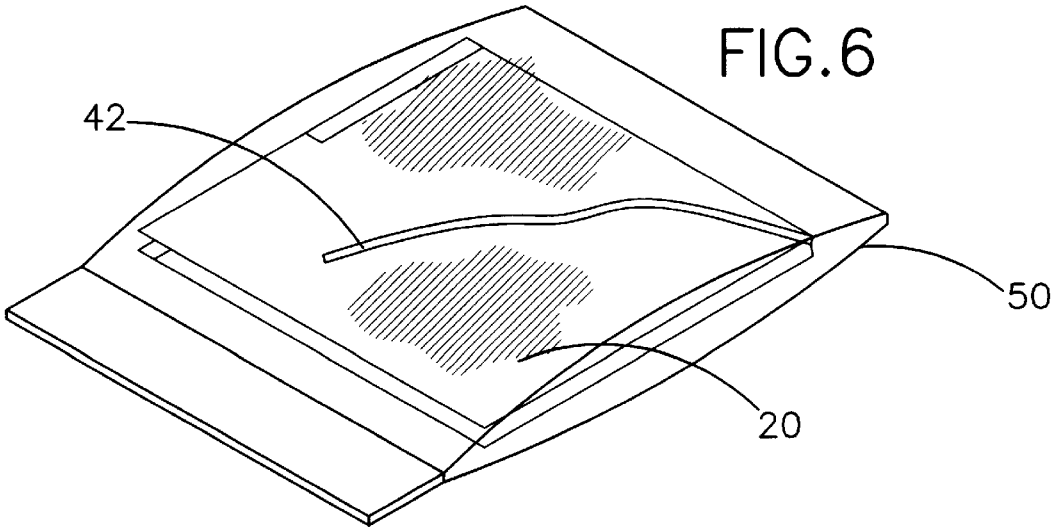
FIG. 6 is a schematic perspective view of the main member stored in the pouch member of the present invention.

With reference now to the drawings, and in particular to FIGS. 1 through 6 thereof, a new mastectomy and shunt coverage assembly embodying the principles and concepts of the present invention and generally designated by the reference numeral 10 will be described.

As best illustrated in FIGS. 1 through 6, the mastectomy and shunt coverage assembly 10 generally comprises a main member 20, an adhesive strip 30, a cover member 32, an annular elastic band 34, a front tab member 40, a rear tab member 42, and a pouch member 50.

The main member 20 includes an opening 22 designed for receiving an arm.

The main member 20 includes a bottom edge 24 designed for positioning adjacent to a waist of the mastectomy patient when the main member 20 is worn by the mastectomy patient.

The main member 20 includes an interior edge with a front portion 26, a top portion 27 and a back portion 28. The front portion 26 is positionable adjacent a chest of the mastectomy patient. The top portion 27 is positionable adjacent to an upper portion of a shoulder of the mastectomy patient. The back portion 28 is positionable adjacent to a back of the mastectomy patient.

The adhesive strip 30 is coupled to the main member 20 along the interior edge of the main member 20 between a front corner of the main member 20 and a medial portion of the back portion 28 of the interior edge of the main member 20. The adhesive strip 30 is designed for removably affixing the interior edge to the mastectomy patient for forming a moisture-proof seal between the interior edge of the main member 20 and skin of the mastectomy patient.

The cover member 32 is removably coupled to the adhesive strip 30 for protecting the adhesive strip 30 until the cover member 32 is removed to permit affixing of the main member 20 to the mastectomy patient.

The opening 22 includes a perimeter edge. The annular elastic band 34 is coupled to the perimeter edge for holding the perimeter edge snugly against the arm of the mastectomy patient. Thus moisture is prevented from passing between the perimeter edge and the arm of the mastectomy patient.

The cover member 32 includes a first portion 36 and a second portion 38. The first portion 36 extends forward toward the front portion 26 of the interior edge of the main member 20 from a medial portion of the top portion 27 of the interior edge of the main member 20. The second portion 38 extends rearward towards the back portion 28 of the interior edge of the main member 20 from the medial portion of the top portion 27 of the interior edge of the main member 20.

The front tab member 40 extends from a proximal end of the first portion 36 of the cover member 32. The front tab member 40 is designed for grasping such that pulling the front tab member 40 exposes a portion of the adhesive strip 30 covered by the first portion 36 of the cover member 32.

The rear tab member 42 extends from a proximal end of the second portion 38 of the cover member 32. The rear tab member 42 is designed for grasping such that pulling the rear tab member 42 exposes a portion of the adhesive strip 30 covered by the second portion 38 of the cover member 32.

The main member 20 is constructed from a moisture-proof flexible material.

The pouch member 50 is used for enveloping the main member 20 prior to use. The pouch member 50 is sealed for preventing contamination of the main member 20 prior to use. The pouch member 50 is tearable for providing access to an interior of the pouch member 50 for permitting removal of the main member 20 from the pouch member 50.

In an embodiment the main member 20 is designed to receive the right arm of the user and cover the right side of the user's chest and back.

In an embodiment the main member 20 is designed to receive the left arm of the user and cover the left side of the user's chest and back.

In an embodiment, the main member 20 is designed to receive both the right and left arms of the user and cover both the right and left sides of the user's chest and back. The main member 20 has two openings 22, two interior edges, two cover members 32, two front tabs 40 and is designed for covering both sides of the users chest and back.

In an embodiment, the rear tab member 42 is approximately one quarter of an inch in width and approximately twenty-four inches in length. The front tab 40 is approximately one quarter of an inch in width and approximately six inches in length. The adhesive strip 30 extends four to six inches down the back portion 28 of the interior edge. The adhesive strip 30 extends down the front portion 26 to the bottom edge 24 of the main member 20.

In use, slips one arm through the opening and positions the main member so that the front portion of the interior edge abuts the user's chest, the top portion of the interior edge abuts the user's shoulder, and the rear portion of the interior edge abuts the back of the user. The user then pulls the front tab member removing the first portion of the cover member from the adhesive. The user runs a finger along an outside surface of the main member adjacent to the medial part of the top portion of the interior edge continuing along the front portion of the interior edge. The user applies a slight pressure with the finger as she follows the interior edge. Thus the adhesive is affixed to the user forming a moisture proof barrier. The user then pulls the rear tab member removing the second portion of the cover member from the adhesive. The user runs a finger along an outside surface of the main member adjacent to the medial part of the top portion of the interior edge continuing along the rear portion of the interior edge. The user applies a slight pressure with the finger as she follows the interior edge. Thus the adhesive is affixed to the user forming a moisture proof. The user then showers in the conventional manner and removes the main member when finished.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mastectomy and shunt coverage assembly for facilitating showering by a mastectomy patient, said mastectomy and shunt coverage assembly comprising:

a main member having an opening adapted for receiving an arm therethrough;

said main member having a bottom edge adapted for positioning adjacent to a waist of the mastectomy patient when said main member is worn by the mastectomy patient;

said main member having an interior edge having a front portion, a top portion and a back portion, said front portion being positionable adjacent a chest of the mastectomy patient, said top portion being positionable adjacent to an upper portion of a shoulder of the mastectomy patient, said back portion being positionable adjacent to a back of the mastectomy patient;

an adhesive strip coupled to said main member along said interior edge of said main member between a front corner of said main member and a medial portion of said back portion of said interior edge of said main member, said adhesive strip being adapted for removably affixing said interior edge to the mastectomy patient for forming a moisture-proof seal between said interior edge of said main member and skin of the mastectomy patient;

a cover member removably coupled to said adhesive strip for protecting said adhesive strip until said cover member is removed to permit affixing of said main member to the mastectomy patient;

said opening having a perimeter edge;

an annular elastic band coupled to said perimeter edge for holding said perimeter edge snugly against the arm of the mastectomy patient whereby moisture is prevented from passing between said perimeter edge and the arm of the mastectomy patient;

said cover member having a first portion and a second portion, said first portion extending forwardly toward said front portion of said interior edge of said main member from a medial portion of said top portion of said interior edge of said main member, said second portion extending rearwardly towards said back portion of said interior edge of said main member from said medial portion of said top portion of said interior edge of said main member;

a front tab member extending from a proximal end of said first portion of said cover member, said front tab member being adapted for grasping such that pulling said front tab member exposes a portion of said adhesive strip covered by said first portion of said cover member;

a rear tab member extending from a proximal end of said second portion of said cover member, said rear tab member being adapted for grasping such that pulling said rear tab member exposes a portion of said adhesive strip covered by said second portion of said cover member;

said main member being constructed from a moisture-proof flexible material;

a pouch member for enveloping said main member prior to use, said pouch member being sealed for preventing contamination of said main member prior to use, said pouch member being tearable for providing access to an interior of said pouch member for permitting removal of said main member from said pouch member.

2. A mastectomy and shunt coverage assembly for facilitating showering by a mastectomy patient, said mastectomy and shunt coverage assembly comprising:

a moisture-proof main member having an opening adapted for receiving an arm therethrough;

said main member having a bottom edge adapted for positioning adjacent to a waist of the mastectomy patient when said main member is worn by the mastectomy patient;

said main member having an interior edge having a front portion, a top portion and a back portion, said front portion being positionable to abut a chest of the mastectomy patient, said top portion being positionable to abut a shoulder of the mastectomy patient, said back portion being positionable to abut a back of the mastectomy patient;

an adhesive strip coupled to said interior edge of said main member for removably affixing a length of said interior edge to the mastectomy patient to form a moisture-proof seal between said length of said interior edge of said main member and skin of the mastectomy patient.

3. The mastectomy and shunt coverage assembly of claim 2, further comprising:

a cover member removably coupled to said adhesive strip for protecting said adhesive strip until said cover member is removed to permit affixing of said main member to the mastectomy patient.

4. The mastectomy and shunt coverage assembly of claim 2, further comprising:

said opening having a perimeter edge;

an annular elastic band coupled to said perimeter edge for holding said perimeter edge snugly against the arm of the mastectomy patient whereby moisture is prevented from passing between said perimeter edge and the arm of the mastectomy patient.

5. The mastectomy and shunt coverage assembly of claim 3, further comprising:

said cover member having a first portion and a second portion, said first portion extending forwardly toward said front portion of said interior edge of said main member from a medial portion of said top portion of said interior edge of said main member, said second portion extending rearwardly towards said back portion of said interior edge of said main member from said medial portion of said top portion of said interior edge of said main member.

6. The mastectomy and shunt coverage assembly of claim 5, further comprising:

a front tab member extending from a proximal end of said first portion of said cover member, said front tab member being adapted for grasping such that pulling said front tab member exposes a portion of said adhesive strip covered by said first portion of said cover member.

7. The mastectomy and shunt coverage assembly of claim 5, further comprising:

a rear tab member extending from a proximal end of said second portion of said cover member, said rear tab member being adapted for grasping such that pulling said rear tab member exposes a portion of said adhesive strip covered by said second portion of said cover member.

8. The mastectomy and shunt coverage assembly of claim 2, further comprising:

said main member being constructed from a moisture-proof flexible material.

9. The mastectomy and shunt coverage assembly of claim 8, further comprising:

a pouch member for enveloping said main member prior to use, said pouch member being sealed for preventing contamination of said main member prior to use, said pouch member being tearable for providing access to an interior of said pouch member for permitting removal of said main member from said pouch member.

* * * * *